US006435172B1

(12) United States Patent
Freemon

(10) Patent No.: US 6,435,172 B1
(45) Date of Patent: Aug. 20, 2002

(54) FIRE STARTING APPARATUS

(76) Inventor: William E. Freemon, 1708 Trace Mills Dr., Suite 1110, Arlington, TX (US) 76014

( * ) Notice: Subject to any disclaimer, the term of this patent is extended or adjusted under 35 U.S.C. 154(b) by 0 days.

(21) Appl. No.: 09/809,908

(22) Filed: Mar. 16, 2001

(51) Int. Cl.[7] ..... A47J 37/00

(52) U.S. Cl. ..... 126/25 B; 126/9 B; 126/154; 126/152 B

(58) Field of Search ..... 126/25 R, 25 B, 126/9 R, 540–542, 152 B, 163 A, 163 R, 152 A; 211/175; 248/172; 108/29, 31, 149

(56) References Cited

U.S. PATENT DOCUMENTS

| | | | | |
|---|---|---|---|---|
| 1,451,195 A | | 4/1923 | Bagley | |
| 1,934,339 A | | 11/1933 | Winberg | |
| 2,519,263 A | * | 8/1950 | Lucas | 126/163 A |
| 3,682,158 A | | 8/1972 | Thomas | 126/165 |
| 4,108,084 A | * | 8/1978 | Fink | 108/29 |
| 4,280,475 A | * | 7/1981 | Truran | 126/152 B |
| 4,955,362 A | | 9/1990 | Underdown | 126/540 |
| 5,076,253 A | | 12/1991 | Lindstro | 126/540 |
| 5,575,275 A | | 11/1996 | Gazaille | 126/540 |
| 6,199,546 B1 | * | 3/2001 | Freemon | 126/25 B |

* cited by examiner

*Primary Examiner*—James C. Yeung
(74) *Attorney, Agent, or Firm*—Henderson & Sturm LLP

(57) ABSTRACT

An improved kindling support apparatus (10) for maintaining a quantity of kindling at a desired height relative to the cross-bars (101) of a main fireplace grate (100) in either a suspended or self-supported fashion wherein the support apparatus (10) includes a kindling grate unit (11) comprising a pair of telescoping grate segments (21) (22) each provided with a grate panel (29) (29') and, a support unit (12) including a plurality of generally L-shaped support leg members (40) (40') that are both rotatably and vertically adjustable relative to the kindling grate unit (11).

15 Claims, 2 Drawing Sheets

FIRE STARTING APPARATUS

CROSS REFERENCE TO RELATED APPLICATIONS

This application is an improvement over patent application Ser. No. 09/576,284, filed May 23, 2000, and entitled "Fire Starting Apparatus," now U.S. Pat. No. 6,199,546, which issued on Mar. 13, 2001.

BACKGROUND OF THE INVENTION

1. Field of the Invention

The present invention relates to the field of fire starting accessories in general and in particular to an adjustable height suspended/stand alone kindling support grate apparatus.

2. Description of Related Art

As can be seen by reference to the following U.S. Pat. Nos. 5,575,275; 5,076,253; 4,955,362; 3,682,158; and 1,451,195, the prior art is replete with myriad and diverse fire starting assistance accessories.

While all of the aforementioned prior art constructions are more than adequate for the basic purpose and function for which they have been specifically designed, they are uniformly deficient with respect to their failure to provide a simple, efficient, and practical apparatus for supporting a quantity of kindling at a desired height relative to a fireplace grate in either a free standing or suspended fashion.

As most fireplace users are all too well aware, the placement of kindling in the proper fashion on a fireplace grate to promote the ignition of progressively larger pieces of firewood is problematic at best due to the simple fact that the introduction of the progressively larger pieces of wood invariably displaces the smaller kindling pieces from their initial placement.

Furthermore, the conventional laying in of firewood and kindling on a fireplace grate often limits and restricts the airflow between the kindling and the main firewood supply.

As a consequence of the foregoing situation, there has existed a longstanding need for a new and improved fire starting apparatus that can be selectively positioned at a desired height beneath a fireplace grate so that the kindling can be maintained at a preferred distance to promote sufficient airflow between the kindling and the main fuel supply to promote quick ignition of the main fuel supply; and the provision of such an apparatus is the stated objective of the present invention.

BRIEF SUMMARY OF THE INVENTION

Briefly stated, the improved fire starting apparatus that forms the basis of the present invention comprises in general an adjustable length kindling grate unit and an adjustable height support unit that is adapted to either suspend the grate unit from the main fireplace grate or to support the kindling grate unit in a self supported fashion beneath the main fireplace grate.

As will be explained in greater detail further on in the specification, the kindling grate unit includes a pair of telescoping grate segments provided with grate panels and having outboard ends associated with the support unit which includes a plurality of generally L-shaped leg support members which are rotatably and vertically adjustable relative to the outboard ends of the telescoping grate segments.

In addition, each of the support leg members has an elongated leg portion and an outwardly extending foot portion which may be hooked over a selected cross-bar on the main fireplace grate when the apparatus is disposed in the suspended mode or rotated downwardly wherein the feet portions of the support leg members contact the floor of a firebox containing the main fireplace grate.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
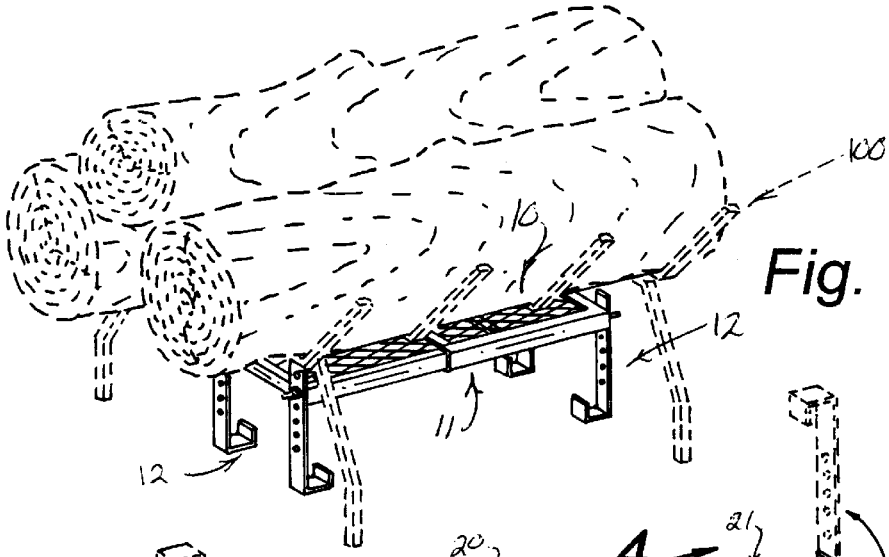
FIG. 1 is a perspective view of the improved fire starting apparatus of this invention disposed in a free standing mode beneath the main fireplace grate.

As can be seen by reference to the drawings, and in particular to FIG. 1, the improved fire starting apparatus that forms the basis of the present invention is designated generally by the reference number 10. The apparatus 10 comprises in general an adjustable length kindling grate unit 11 and an adjustable height support unit 12. These units will now be describe in seriatim fashion.

Figure 2:
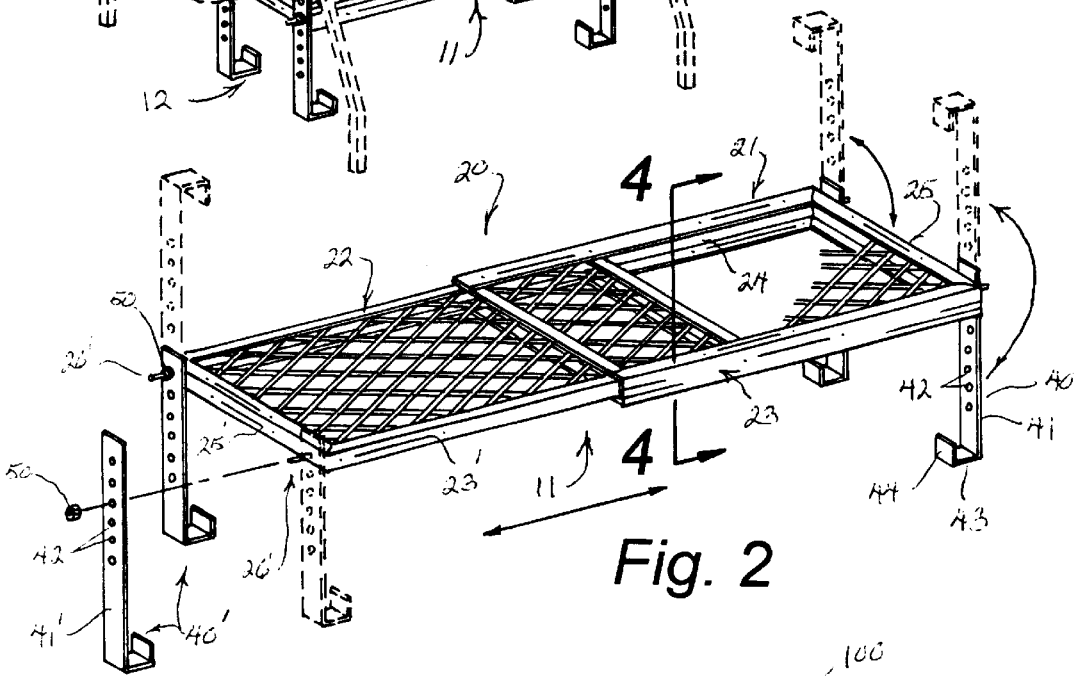
FIG. 2 is a partially exploded perspective view of the apparatus in the free standing mode.
Figure 3:
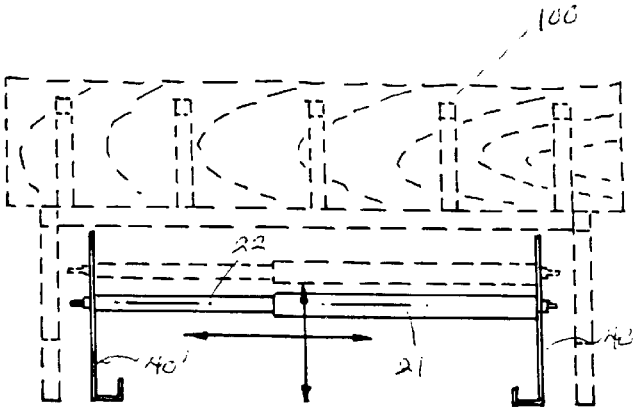
FIG. 3 is a side elevation view of the arrangement depicted in FIG. 1.
Figure 4:
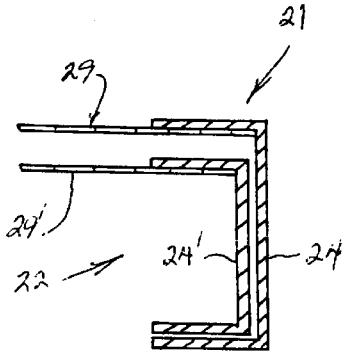
FIG. 4 is a cross-sectional view taken through line 4–4 of FIG. 2.
Figure 5:
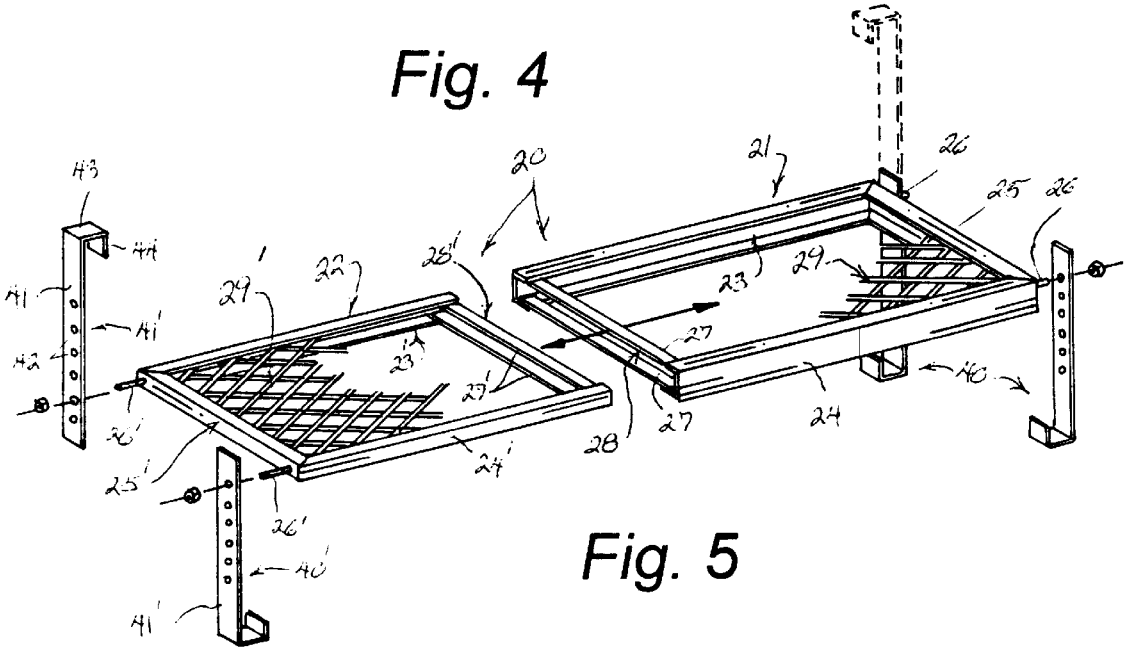
FIG. 5 is an isolated exploded perspective view of the improved fire starting apparatus.
Figure 6:
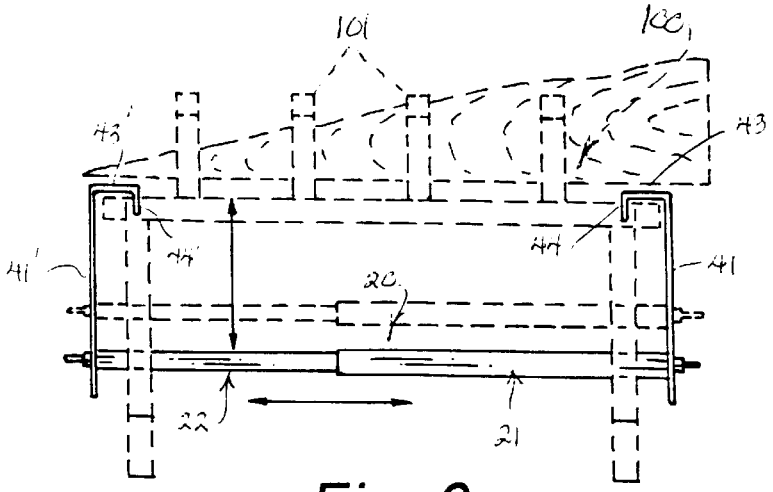
FIG. 6 is a side elevation view of the fire starting apparatus disposed in the suspended fashion.

As can best be seen by reference to FIGS. 2, 4 and 5, the kindling grate unit 11 comprises an adjustable length grate member 20 including an outer 21 and an inner 22 grate segment; wherein, each grate segment 21 22 is respectively provided with a generally rectangular outer framework element 23 23' fabricated from a generally C-shaped channel section 24 24' arranged in a U-shaped configuration wherein the closed outboard ends 25 25' of each grate segment 21 22 are provided with widely spaced pairs of threaded mounting posts 26 26'.

In addition, as shown in FIG. 5, the inboard ends of both the outer 21 and inner 22 grate segments are provided with pairs of cross-arms 27 27' that define elongated rectangular openings 28 28' wherein the outer grate segment opening 28 is dimensional to slidably receive the inner grate segment 22 in a well recognized fashion.

Furthermore, as shown in FIGS. 4 and 5, each of the grate segments 21 22 is provided with an open latticework grate panel 29 which is securely connected to the interior of either the top or bottom part of the C-shaped channel sections 24 24' of each of the framework sections 23 23' to provide a support surface for a quantity of kindling.

At this juncture, it should be noted that the reason that the securement of the grate panels to the interior of either the top or bottom portion of the C-shaped channel sections 24 24' of each grate segment 21 22 is optional is not only because the inner 22 and outer 21 grate sections cooperate with one another in a telescopic fashion, but also, due to the fact that under certain circumstances, such as windy or drafty conditions, the user will desire the ability to form a grated enclosure for the kindling to limit the potential dispersion of sparks from the kindling.

Under those particular conditions, the grate panels 29 29' will be arranged in a vertically spaced orientation relative to one another simply by inverting one grate segment 21 relative to the other grate segment 22 from the orientation depicted in the drawings. As a consequence of the inversion, the overlapping portions of the grate panels 29 29' will define a variable length, open ended grated enclosure for that quantity of kindling disposed between the over lapped grate panels 29 29'.

Turning now to FIGS. 2, 3, 5 and 6, it can be seen that the support unit 12 comprises two pairs of generally L-shaped support leg members 40 40' wherein each of the support leg members 40 40' has an upper elongated leg portion 41 41' provided with a plurality of apertures 42 42' and a lower outwardly extending foot portion 43 43' provided with an upturned toe section 44 44' whose purpose and function will be described presently.

In the self supported stand-alone mode disposition illustrated in FIGS. 1 through 3 and 5, each of the support legs 40 40' is disposed in a downwardly depending fashion from the respective grate segments 21 22 wherein the weight of the apparatus 10 is supported on the foot portions 43 43'. However, in the suspended mode of disposition, illustrated in phantom in FIG. 2, and by solid lines in FIG. 6, each pair of support leg members 40 40' is rotated 180° to an upwardly oriented position so that the foot portions 43 43' can be draped over and suspended from selected cross-bars 101 of the main fireplace grate 100; and, wherein the toe sections 44 44' will prevent the support leg members 40 40' from becoming laterally displaced and disengaged from the fireplace grate cross-bars 101 in a well recognized fashion.

It should further be noted at this juncture that the threaded mounting posts 26 26' are provided with conventional fasteners 50 so that the mounting posts 26 26' can pass through selected apertures 42 in the leg portion 41 of each support leg 40 40' to maintain the housing segments 21 22 at a desired height from the bottom of the main fireplace grate 100 in either the self supported or suspended mode of disposition of the apparatus 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An improved kindling support apparatus for maintaining a quantity of kindling at a desired height relative to the cross-bars of a main fireplace grate; wherein, the support apparatus comprises a kindling grate unit including at least one grate segment provided with a generally rectangular framework element having a grate panel associated therewith; and, a support unit including a plurality of generally L-shaped support leg members rotatably associated in a vertical plane with spaced portions of said at least one grate segment; whereby the support leg members can be translated from suspended disposition relative to the grate unit to a self supported disposition.

2. The support apparatus as in claim 1; wherein, each support leg member includes a leg portion and an outwardly extending foot portion.

3. The support apparatus as in claim 2; wherein, each leg portion is elongated relative to the foot portion.

4. The support apparatus as in claim 2; wherein, each foot portion is further provided with an upturned toe section.

5. The support apparatus as in claim 3; wherein, each foot portion is further provided with an upturned toe section.

6. The support apparatus as in claim 1; wherein, each support leg member is vertically adjustable relative to said at least one grate segment.

7. The support apparatus as in claim 2; wherein, each support leg member is vertically adjustable relative to said at least one grate segment.

8. The support apparatus as in claim 4; wherein, each support leg member is vertically adjustable relative to said at least one grate segment.

9. An improved kindling support apparatus for maintaining a quantity of kindling at a desired height relative to the cross-bars of a main fireplace grate; wherein, the apparatus comprises:

a kindling grate unit including an adjustable length kindling grate member having a pair of telescoping grate segments including an inner and an outer grate segment both having outboard ends; and, a support unit including a plurality of generally L-shaped support leg members rotatably associated in a vertical plane with the outboard ends of said inner and outer grate segments.

10. The support apparatus as in claim 9; wherein, said plurality of support leg members is vertically adjustable relative to the outboard ends of said inner and outer grate segments.

11. The support apparatus as in claim 9; wherein, each of said grate segments includes a generally rectangular framework element an a grate panel.

12. The support apparatus as in claim 10; wherein, each of said grate segments includes a generally rectangular framework element an a grate panel.

13. The support apparatus as in claim 9; wherein, each support leg member includes a leg portion and an outwardly extending foot portion.

14. The support apparatus as in claim 13; wherein, each leg portion is elongated relative to the foot portion.

15. The support apparatus as in claim 13; wherein, each foot portion is further provided with an upturned toe section.

* * * * *